US012117233B2

(12) United States Patent
Hosamani et al.

(10) Patent No.: US 12,117,233 B2
(45) Date of Patent: Oct. 15, 2024

(54) REFRIGERATION APPLIANCE HAVING AN AIR DISTRIBUTOR

(71) Applicant: BSH Hausgeräte GmbH, Munich (DE)

(72) Inventors: Prashantagouda Hosamani, Ulm (DE); Renate Pradel, Giengen (DE); Thomas Schaefer, Giengen (DE); Claudia Weiss, Illerkirchberg (DE)

(73) Assignee: BSH Hausgeräte GmbH, Munich (DE)

( * ) Notice: Subject to any disclaimer, the term of this patent is extended or adjusted under 35 U.S.C. 154(b) by 126 days.

(21) Appl. No.: 17/910,425

(22) PCT Filed: Feb. 18, 2021

(86) PCT No.: PCT/EP2021/053951

§ 371 (c)(1),
(2) Date: Sep. 9, 2022

(87) PCT Pub. No.: WO2021/180440

PCT Pub. Date: Sep. 16, 2021

(65) Prior Publication Data

US 2023/0137690 A1 May 4, 2023

(30) Foreign Application Priority Data

Mar. 11, 2020 (DE) ..... 10 2020 203 080.4

(51) Int. Cl.
*F25D 23/06* (2006.01)
*F25D 17/08* (2006.01)

(52) U.S. Cl.
CPC ..... *F25D 23/065* (2013.01); *F25D 17/08* (2013.01); *F25D 2317/067* (2013.01)

(58) Field of Classification Search
CPC .. F25D 23/065; F25D 17/08; F25D 2317/067; F25D 23/061; F25D 23/068; F25D 23/066
See application file for complete search history.

(56) References Cited

U.S. PATENT DOCUMENTS

2016/0097578 A1 4/2016 Hyun
2018/0164029 A1 6/2018 Lindel et al.
(Continued)

FOREIGN PATENT DOCUMENTS

CN 104713309 A 6/2015
DE 102014224648 A1 6/2016
(Continued)

OTHER PUBLICATIONS

KR-20120001863-A (Year: 2012).*
WO-2012130637-A2 (Year: 2012).*
WO-2019233760-A1 (Year: 2019).*

*Primary Examiner* — David J Teitelbaum
(74) *Attorney, Agent, or Firm* — Laurence A. Greenberg; Werner H. Stemer; Ralph E. Locher

(57) ABSTRACT

A refrigeration appliance has an internal container, which has a back wall and side walls, and an air distributor cladding which is arranged on the back wall and bounds an air distributor duct. A visible surface of the air distributor cladding covers a majority of the width of the back wall. Side faces of the air distributor cladding, together with the internal container, bound grooves that run on either side of the air distributor cladding and that are open towards a front side of the internal container. Outlet openings of the air distributor cladding are formed on the side faces.

16 Claims, 2 Drawing Sheets

(56) References Cited

U.S. PATENT DOCUMENTS

| | | | | |
|---|---|---|---|---|
| 2018/0274840 | A1* | 9/2018 | Fei | F25D 17/045 |
| 2019/0368800 | A1* | 12/2019 | Cheng | F25D 23/061 |

FOREIGN PATENT DOCUMENTS

| | | | | | |
|---|---|---|---|---|---|
| DE | 102015203145 | A1 | | 8/2016 | |
| DE | 102016224610 | A1 | | 6/2018 | |
| EP | 3163229 | A1 | | 5/2017 | |
| KR | 20120001863 | A | * | 1/2012 | |
| WO | 2006120099 | A1 | | 11/2006 | |
| WO | WO-2012130637 | A2 | * | 10/2012 | F25D 17/062 |
| WO | WO-2019233760 | A1 | * | 12/2019 | F04D 19/002 |

* cited by examiner

REFRIGERATION APPLIANCE HAVING AN AIR DISTRIBUTOR

FIELD AND BACKGROUND OF THE INVENTION

With frost-free refrigeration appliances, the evaporator is accommodated in an evaporator chamber which is separated from the storage area for items to be refrigerated, and air is circulated between this and the evaporator chamber in order to cool the storage area. In order to achieve a uniform cooling of the entire storage area, the air cooled on the evaporator must be distributed uniformly in the storage area. An air distributor which supplies cold air to different regions of the storage area by way of a plurality of openings which are spaced apart from one another is required to ensure that this can be achieved independently of the positioning of shelves, pull-out boxes or suchlike which hinder the air circulation in the storage area and due to items to be refrigerated positioned thereon/therein.

DE 10 2015 203 145 A1 and DE 10 2014 224 648 A1 disclose refrigeration appliances having an air distributor. An air duct of this known distributor runs in each case in a flat groove, which is molded in a rear wall of an internal container, and which is differentiated from the storage area by a cladding locked to lateral flanks of the groove. An escape of air from the air duct is therefore only possible by way of noticeable openings in a visible surface of the cladding. If the storage area is typically to be divided by shelves, then the height of the compartments produced as a result should be able to be selected as freely as possible to ensure that the user is able to adjust them to his/her requirements. The position of the openings is fixed, however, so that an unfavorable positioning of the shelves may result in a compartment, into which no opening leads, only being poorly cooled, whereas another is possibly cooled more intensely than necessary. The lack of coordination between the positions of the openings and the shelves is also esthetically unsatisfactory for the user.

SUMMARY OF THE INVENTION

An object of the present invention is therefore to create a refrigeration appliance having an air distributor which enables a satisfactory distribution of cold air onto several compartments of a storage area independently of the positioning of the shelves. A further object is to create a refrigeration appliance, the storage area of which offers a tidy, esthetically satisfactory aspect.

For this purpose, it is proposed, in the case of a refrigeration appliance with an internal container having a rear wall and side walls, and an air distributor cladding arranged on the rear wall to make a visible surface of the air distributor cladding so wide that it covers the majority of the width of the rear wall and that side surfaces of the air distributor cladding, together with the internal container bound grooves that run on either side of the air distributor cladding and that are open toward a front side of the internal container (2), and to provide outlet openings of the air distributor cladding on the side surfaces. The outlet openings can be elongated vertically and in this way already favor a uniform distribution vertically, in addition the inevitable deflection of the air into the grooves also promotes an expansion of the flow of air vertically. The quantity of air allotted to a compartment of the storage zone is as a result substantially proportional to its height, but dependent only to a minor extent upon how many openings are in the height of the compartment in question.

The visible surface is preferably level and can be kept completely free of outlet openings. This offers on the one hand an esthetically satisfying aspect, on the other hand the level wall surface facilitates the use of the space in front of it with the aid of shelves extending close to the visible surface. The lack of openings on the visible side also helps keep the storage area clean.

Due to the technology of its production the side walls of an internal container are generally connected with its rear wall by way of rounding zones which are curved along a vertical axis. This rounding is used in accordance with the invention to forwardly deflect the flow of air leaving the openings of the air distributor only in the width direction of the refrigeration appliance in a low-loss manner.

For this purpose, the distance of the visible surface from the rear wall should be smaller than the double curvature radius of the rounding zones, it is preferably smaller than the single curvature radius of the rounding zones.

The depth of the grooves preferably amounts to between 0.5 times and double their width.

An air distributor duct concealed by the air distributor cladding can run in a cut-out in a rear side of the air distributor cladding facing the rear wall. An area of the rear wall which likewise bounds the air distributor duct can be level and flush with the rest of the rear wall; in other words, the rear wall preferably extends in a straight line between the areas of the air distributor cladding which make contact with the cut-out on either side.

At least the areas of the air distributor cladding adjoining the air duct can be molded from foam, in particular expanded polystyrene. The visible side can be in particular an injection molded part or a rigid film which lines the foam.

In order to avoid a time-consuming screwing process, the air distributor cladding can be displaceably guided on the rear wall between an engaging position, in which it is fixed in the depth direction of the internal container, and an extraction position, in which it can be moved in the depth direction. The direction of the guidance is preferably vertical, therefore in order to move the air distributor cladding between the engaging position and the extraction position said air distributor cladding can be grasped from both sides by way of the grooves.

A groove between an upper narrow side of the air distributor cladding, which is open in the engaging position, can offer the freedom of movement required for the transition into the extraction position. In the engaging position, the grooves form a continuous frame, which, with a preferably constant width, pulls along three edges of the air distributor cladding.

The groove along the upper narrow side of the air distributor cladding can naturally also be used to provide an outlet opening there.

If the side walls and the ceiling of the internal container are connected in a per se known manner with the horizontal axis by means of a rounding zone in each case, an esthetically satisfactory design can in particular be achieved in that the axis of each rounding zone intersects one of the upper corners of the visible surface.

In order to fix the air distributor cladding in the engaging position in the depth direction, at least one pocket can be molded to the rear wall and in the engaging position a locking projection of the air distributor cladding engages into an undercut area of the pocket.

Areas of at least two pockets which are undercut on the rear wall are preferably arranged in a mirror-inverted manner with respect to one another and are bounded by edges of the rear wall which run at an acute angle with respect to one another. By locking projections of the air distributor cladding engaging in both pockets and being exposed to forces which oppose one another in the width direction when in contact with the edges, the air distributor cladding is on the one hand centered in the width direction upon transition into the engaging position, on the other hand production tolerances of the pockets can be compensated to a certain degree by a more or less significant deformation of the locking projections at the edges.

In order to determine precisely the position of the air distributor cladding in the engaging position, a reinforcing part can be mounted on the rear wall, concealed by the air distributor cladding, on which reinforcing part the air distributor cladding in the engaging position is held immovably in the depth direction. As the position of the reinforcing part is only fixed after assembly of the air distributor cladding during foaming, it is possible during the mounting process to optimize the position of the air distributor cladding in respect of a uniform width of the grooves; since the reinforcing part is fixed in contact with the foam, the once set position can be reliably reestablished after each disassembly of the air distributor cladding.

An evaporator cover which is mounted in the internal container downstream of the air distributor cladding can be used to secure the air distributor cladding in the engaging position. For this purpose, a lower edge area of the air distributor cladding can engage in particular in a gap between the rear wall and an evaporator cover and have at least one cut-out or a projection which extends in the depth direction and interacts with a complementary projection or a complementary depression of the rear wall or the evaporator cover. By the evaporator cover blocking a disengaging of the projection from the cut-out, the evaporator cover is prevented from being able to be detached by untrained persons. It is therefore possible in particular to prevent a user from coming into contact with voltage-carrying components behind the evaporator cover.

The cut-out or the projection is preferably provided on two lower corners of the air distributor cladding, in particular on arms of the air distributor cladding which project downward above a lower edge of the visible surface. There is therefore sufficient space between the two for an inlet opening, by way of which cold air extends from the evaporator into the air duct.

The complementary depression or the complementary projection is preferably provided in the rear wall. The engaging position is then only reachable if the air distributor cladding is bent there temporarily on the way from the extraction point; however, at the same time this bending also ensures a provisional securing of the air distributor cladding in the engaging position if the evaporator cover is not (yet) mounted.

Further features and advantages of the invention become apparent from the subsequent description of exemplary embodiments with reference to the appended figures.

DETAILED DESCRIPTION OF THE INVENTION

Figure 1:
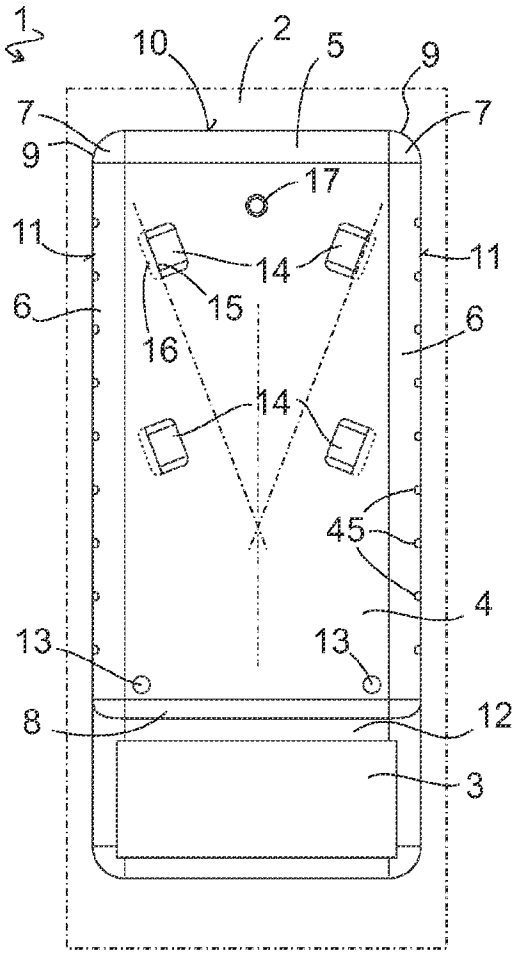
FIG. 1 shows a front view of an internal container.

FIG. 1 shows a view frontally from the front onto the carcass 1 of an unfinished refrigerator. An evaporator 3 is mounted in the lower area of an internal container 2, a cover, which will subsequently divide the internal container 2 in the storage area and evaporator chamber, is still missing.

Above the evaporator 3 the internal container 2 has a level upper rear wall 4 which is surrounded along its lateral and upper edges by approximately quarter cylindrical rounding zones 5, 6 and at the corners by spherical rounding zones 7. A ceiling 10 and side walls 11 of the internal container 2 or rounding zones 9 connecting ceiling 10 and side walls 11 adjoin the rounding zones 5, 6. Ribs 45 which are to be used as support for shelves still to be mounted are molded on the side walls 11. A chamfer 8 compensates for an offset in the depth direction of the carcass 1 between the upper rear wall 4 and a lower rear wall 12, in front of which the evaporator 3 is mounted.

Two depressions 13, here in the form of hollow cylinders or truncated cones, the axis of which is at right angles to the rear wall 4 in each case, are molded on the rear wall 4 just above the evaporator 3.

A number of pockets 14 are molded in a top area of the rear wall 4. The pockets 14 each have an edge 15, behind which, viewed from a direction at right angles to the rear wall, there lies an undercut area 16.

As shown in FIG. 1, the pockets 14 can face one another in a mirror-inverted manner on either side of a vertical center plane. The edges 15 run at an angle with respect to the horizontal, in particular the edges 15 of two pockets 14 which face one another in a mirror-inverted manner span an acute angle.

Furthermore, a reinforcing part 17 is mounted in at least one opening cut in the rear wall 3, said reinforcing part supporting a pin projecting through the opening into the internal container 2. The opening is slightly larger than the pin so that the position of the reinforcing part 17 can be adjusted in the height and width direction of the internal container 2.

Figure 2:
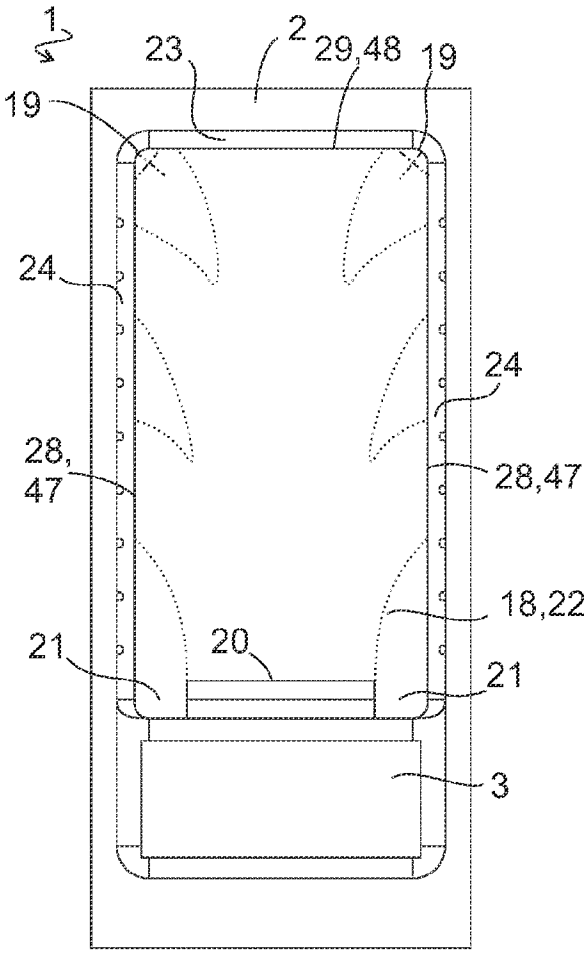
FIG. 2 shows the internal container from FIG. 1 with an air distributor cladding mounted therein.

The depressions 13, pockets 14 and reinforcing parts 17 are used to fasten an air distributor cladding 18, which is shown mounted in the internal container 2 in FIG. 2. The air distributor cladding 18 has the shape of a substantially rectangular plate, here with rounded corners 19 on an upper edge, and with two arms 21 which project above a lower edge 20. A visible surface 22 of the air distributor cladding 18 facing the observer or the storage area is level and free of openings. The visible side 22 can be a plate injection molded from solid plastic.

In the mounted position, the visible side 22 is raised above the rear wall 4 and surrounded at the top and on the sides by grooves 23, 24, the bases of which are formed in each case by the rounding zones 5, 6. The width of the grooves 23, 24 is in each case the same and slightly smaller than the curvature radius of the rounding zones 5, 6. An axis of the curvatures zones 9 intersect in each case the upper corners 19 of the air distributor cladding 18. If the air distributor cladding 18 is mounted precisely, points of intersection 46 of the axes coincide in each case with the center points of the quadrant arcs forming the corners 19.

The lower ends of the arms 21 extend as far as the lower rear wall 12. One part of the chamfer 8 is exposed therebetween.

Figure 4:
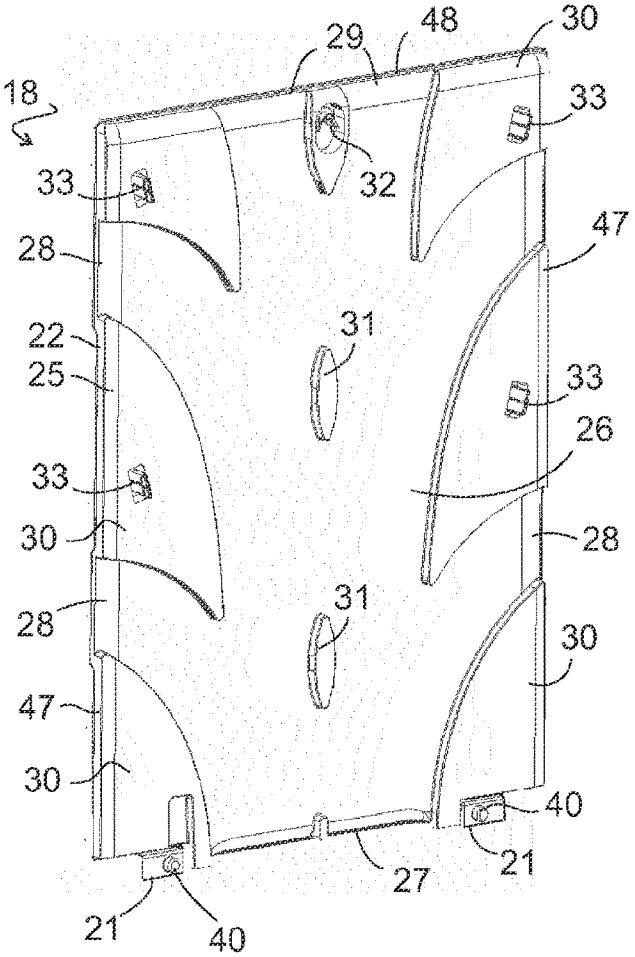
FIG. 4 shows a view of the air distributor cladding from the rear.

FIG. 4 shows the air distributor cladding 18 in a perspective view from the rear side (facing the rear wall 4 in the fully mounted state). The visible side 22 is here largely covered by a flat mold 25 made from foam, typically from expanded polystyrene. An air distributor duct 26 is recessed on the rear side of the mold 25. An inlet opening 27, by way of which in the mounted state cold air extends from the evaporator 3 into the air distributor duct 26, is located on the lower edge 20 of the air distributor cladding 18, between the arms 21. From there the air distributor duct 26 extends upward, wherein it branches repeatedly to form outlet openings 28, 29 leading into the grooves 23 and 24 on side surfaces 47 and an upper narrow side 48 of the air distributor cladding 18. Areas 30 of the mold which project on either side of the air distributor duct 26 tightly abut the rear wall 4 in the mounted state so that the cross-sectionally rectangular air distributor duct 26 is bounded on two narrow sides and a broadside by the mold 25 and on a second broadside by the rear wall 4.

Individual projecting areas 31 of the mold 25 in the middle of the air distributor duct 26 are used to support the air distributor cladding 18 against pressure exerted thereagainst from the front, out of the storage area.

Some of the projecting areas 30, 31 have in each case a passage, through which a locking projection 32, 33 extends. The locking projections 32, 33 are preferably integral with the plate forming the visible side 22.

The arms 21 in each case support a pin-shaped projection 40, the distal end of which projects beyond those of the projecting areas 30, 31.

Figure 5:
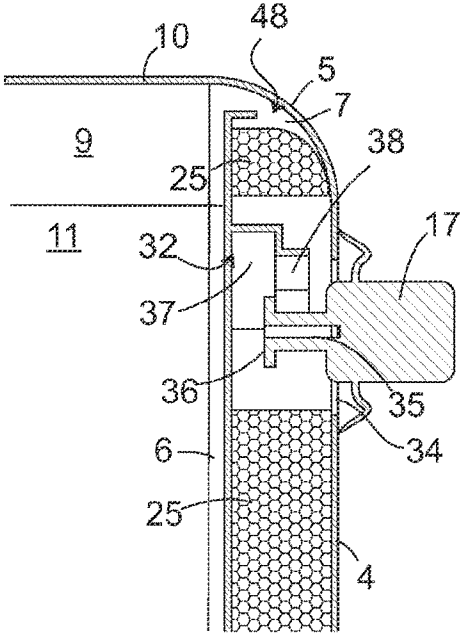
FIG. 5 shows a schematic section through the reinforcing part and a part of the air distributor cladding in the extraction position.

FIG. 5 shows a section through an upper corner of the internal container 2 with a part of the rear wall 4, the ceiling 10, the rounding zone 5 arranged therebetween and the reinforcing part 17, the pin of which projects through the opening 34 into the internal container 2. The pin comprises a shaft 35 and a head 36, the diameter of which is larger than that of the shaft 35. The air distributor cladding 18 is shown in an extraction position, in which it rests against the rear wall 4, but is freely movable in a direction at right angles to the rear wall 4 and can be removed from the internal container 2. Its locking projection 32 has, complementary to the shape of the pin, two semicircular-shaped cut-outs, a proximal cut-out 37 with a diameter fitted to the head 36 and a distal cut-out 38 with a diameter fitted to the shaft 35. If the air distributor cladding 18 is lowered out of the extraction position into an engaging position, the groove 23 between the ceiling 10 and the top edge of the air distributor cladding 18 opens, and by the head 36 and shaft 35 engaging in the complementary cut-outs 37, 38, the air distributor cladding 18 is made immobile in the vertical direction with respect to the rear wall 4.

The head 36 and shaft 35 can be slotted in order to enable a minimal elastic deformation and thus a play-free clamping fit when engaging in the cut-outs.

Since the shaft 35 penetrates the opening 34 while maintaining play, the position of the reinforcing part 17 on the rear wall can still be corrected after establishing engagement with the locking projection 32 in order to set a uniform width of the grooves 23, 24 annularly around the air distributor cladding 18. After adjustment, the reinforcing part can be provisionally fixed, e.g. by adhesive, to the exterior of the rear wall, in order then to be permanently fixed by embedding in an insulating foam layer attached in a per se known manner annularly about the internal container 2.

Figure 6:
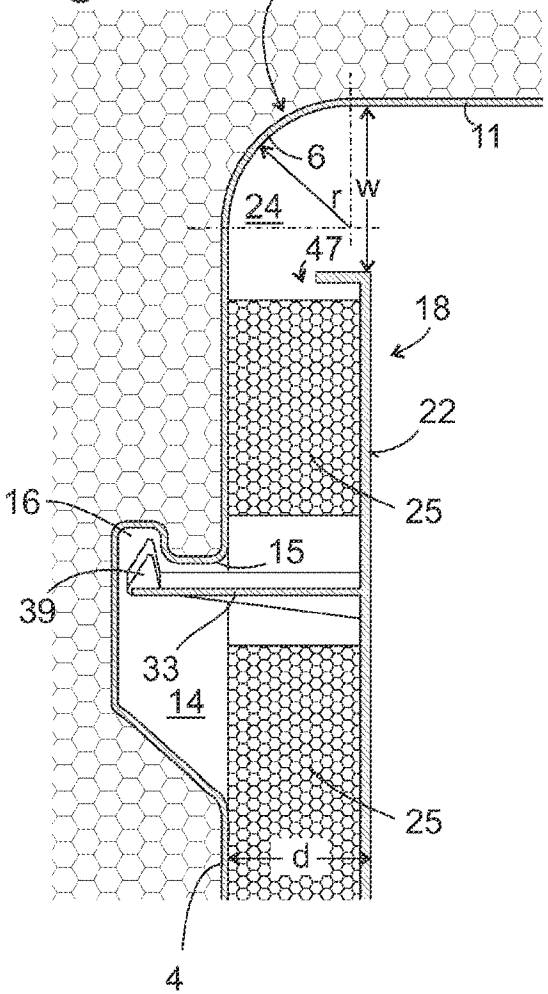
FIG. 6 shows a schematic section through a pocket of the internal container and a locking hook of the air distributor cladding which engages therein.

FIG. 6 shows a horizontal section through one of the grooves 24 and its surroundings. The thickness of the air distributor cladding 18 or the distance d between its visible side 22 and the rear wall 4 is here marginally smaller than the radius r of the rounding zone 6, so that a flow of air out of an outlet opening 28 over its entire width strikes the rounding zone 6 and is deflected hereon in a substantially laminar manner toward a front side of the appliance. The width w of the groove 24 is slightly larger than the radius so that the rear wall 4 projects slightly on both sides of the air distributor cladding 18 and the projecting areas 30, 31 of the mold can be flat and rest against the entire surface of the rear wall 4.

FIG. 6 further shows one of the pockets 14 of the rear wall 4 and a locking projection 33 engaging therein. The locking projection 33 is in the shape of a hook with a tip 39, which is provided to engage in the undercut area 15 of the pocket 14, behind the edge 16.

Since the edge 16 runs obliquely with respect to the direction of movement between the extraction and engaging position, the path which the locking projection 33 covers at right angles to the edge 16 is shorter than that of the air distributor cladding 18 between the extraction and engaging position. Since moreover the pockets 14 and the locking projections 33 engaging therein are arranged in a mirror-inverted manner with respect to one another, the locking projections 33 can strike the edges 16 before reaching the engaging position and are elastically deflected against these until reaching this engaging position; this ensures that the air distributor cladding 18 is fixed to the rear wall 4 without play.

In order to insert the locking projections 33 so deeply into the pockets 14 that their tips 39 can reach the undercut areas 15, the projecting areas 30, 31 must be brought into contact on the rear wall. Since the projections 40 of the arms 21 in the relaxed state project beyond the plane of the projecting areas 30, 31, this is only possible if the arms 21 are elastically deflected in the process. If the projecting areas 30, 31 rest against the rear wall 4, the air distributor cladding 18 is displaced downward along the rear wall 4 until the projections 40 reach the depressions 13 and engage herein. Once this occurs, a further downward movement is blocked and the engaging position is reached. At the same time, the elastic locking of the projections in the depressions provides for a provisional, not readily detachable anchoring of the air distributor cladding 18 in the internal container 2.

Figure 3:
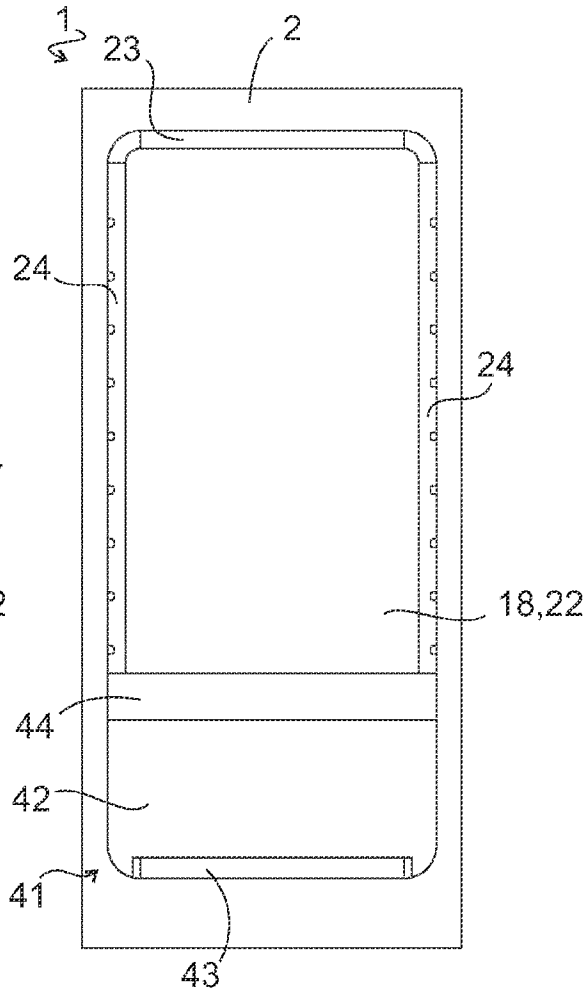
FIG. 3 shows the internal container with an evaporator cover mounted in front.

In a subsequent mounting step, an evaporator cover 41 is mounted upstream of the evaporator 3, as shown in FIG. 3. The evaporator cover 41 has a vertical wall 42, the lower edge of which bounds an intake opening 43. The vertical wall 42 rests in in the mounted state against the evaporator 3, and functions as a bypass blocker, which prevents a flow of air past the evaporator 3. An oblique wall 44 upwardly adjoins the vertical wall 42 and runs toward the air distributor cladding 18, conceals its arms 21 and the intermediate inlet opening 27 and rests with its upper edge tightly against the visible side 22. By the evaporator cover 41 thus blocking the access to the arms 21 and simultaneously rendering impossible a bending of the air distributor cover 18, by means of which the projections 40 could detach from the depressions 13, it reliably prevents disassembly of the air distributor cover 18 by untrained persons.

REFERENCE CHARACTERS

1 carcass
2 internal container

3 evaporator
4 rear wall
5 rounding zone
6 rounding zone
7 rounding zone
8 chamfer
9 rounding zone
10 ceiling
11 side wall
12 rear wall
13 depression
14 pocket
15 edge
16 undercut area
17 reinforcing part
18 air distributor cladding
19 corner
20 lower edge
21 arm
22 visible side
23 groove
24 groove
25 mold
26 air distributor duct
27 inlet opening
28 outlet opening
29 outlet opening
30 projecting area
31 projecting area
32 locking projection
33 locking projection
34 opening
35 shaft
36 head
37 cut-out
38 cut-out
39 tip
40 projection
41 evaporator cover
42 vertical wall
43 intake opening
44 oblique wall
45 rib
46 point of intersection
47 side surface
48 upper narrow side

The invention claimed is:

1. A refrigeration appliance, comprising:

an internal container having a rear wall and side walls;

an air distributor cladding disposed on said rear wall and bounding an air distributor duct, said air distributor cladding having a visible surface covering a majority of a width of said rear wall and side surfaces, said side surfaces, together with said internal container, bounding grooves that run on either side of said air distributor cladding and that are open toward a front side of said internal container, and said air distributor cladding having outlet openings formed on said side surfaces, wherein said air distributor cladding is movably guided on said rear wall between an engaging position, in which said air distributor cladding is fixed in a depth direction of said internal container, and an extraction position, in which said air distributor cladding can be moved in the depth direction; and an evaporator cover, wherein said air distributor cladding has a lower edge area that engages between said rear wall and said evaporator cover and at least one cut-out or a projection, which extends in the depth direction and interacts with a complementary depression or a complementary projection of said rear wall or said evaporator cover, in order to fix said air distributor cladding in the engaging position.

2. The refrigeration appliance according to claim 1, wherein said visible surface is level.

3. The refrigeration appliance according to claim 1, wherein said side walls of said internal container are connected to said rear wall by way of rounding zones and that a distance of said visible surface from said rear wall is smaller than a double curvature radius of said rounding zones.

4. The refrigeration appliance according to claim 1, wherein said grooves have a depth that is between 0.5 times and double a width of said grooves.

5. The refrigeration appliance according to claim 1, wherein said air distributor duct is bounded by a cut-out in a rear side of said air distributor cladding facing said rear wall, and that said rear wall extends in a straight line between areas of said air distributor cladding which project and touch on both sides of said cut-out.

6. The refrigeration appliance according to claim 1, wherein in the engaging position a further groove between an upper narrow side of said air distributor cladding and a ceiling of said internal container is open.

7. The refrigeration appliance according to claim 6, wherein said upper narrow side has at least one outlet opening formed therein.

8. The refrigeration appliance according to claim 6, wherein said side walls and said ceiling of said internal container are connected in each case by a rounding zone with a horizontal axis and that the horizontal axis of each said rounding zone intersects a corner of said visible surface.

9. The refrigeration appliance according to claim 1, wherein:

said rear wall has at least one pocket molded therein with an undercut area; and said air distributor cladding has a locking projection that engages in the engaging position in said undercut area of said at least one pocket.

10. The refrigeration appliance according to claim 9, wherein:

said at least one pocket is one of a plurality of pockets; and undercut areas of at least two of said pockets are disposed in a mirror-inverted manner with respect to one another on said rear wall and are bounded by edges of said rear wall which run at an acute angle with respect to one another.

11. The refrigeration appliance according to claim 1, further comprising a reinforcing part mounted on said rear wall; and wherein said air distributor cladding conceals said reinforcing part mounted on said rear wall and in the engaging position said air distributor cladding is held immovably in the depth direction on said reinforcing part.

12. The refrigeration appliance according to claim 1, wherein said cut-out or said projection are provided on two lower corners of said air distributor cladding.

13. The refrigeration appliance according to claim 1, wherein said complementary depression or said complementary projection is disposed in said rear wall.

14. The refrigeration appliance according to claim 2, wherein said visible surface is free of outlet openings.

15. The refrigeration appliance according to claim 3, wherein the distance of said visible surface from said rear wall is smaller than a single curvature radius of said rounding zones.

16. The refrigeration appliance according to claim 12, wherein said air distributor cladding has arms which project downward above a lower edge of said visible surface and said cut-out or said projection is provided on each of said arms.

* * * * *